US008251239B2

(12) United States Patent
Yeung

(10) Patent No.: US 8,251,239 B2
(45) Date of Patent: Aug. 28, 2012

(54) SEALING LID

(75) Inventor: Hin Shing Ken Yeung, Kowloon (CN)

(73) Assignee: SAR Holdings International Limited, Kowloon (HK)

( * ) Notice: Subject to any disclaimer, the term of this patent is extended or adjusted under 35 U.S.C. 154(b) by 980 days.

(21) Appl. No.: 11/804,218

(22) Filed: May 17, 2007

(65) Prior Publication Data

US 2011/0095022 A1 Apr. 28, 2011

(51) Int. Cl.
*B65D 53/04* (2006.01)
*B65D 51/12* (2006.01)

(52) U.S. Cl. ..... 220/240; 220/287; 220/305

(58) Field of Classification Search ..... 220/240, 220/305, 720, 287
See application file for complete search history.

(56) References Cited

U.S. PATENT DOCUMENTS 2,212,804 A * 8/1940 Wynings et al. ..... 215/200
2,503,944 A * 4/1950 Frascari ..... 53/440
3,109,575 A * 11/1963 Aldington ..... 229/123.2
3,559,843 A * 2/1971 Kern ..... 220/281
3,901,405 A 8/1975 Norberg
4,157,764 A * 6/1979 Moller ..... 220/260
6,478,218 B1 * 11/2002 Boatwright et al. ..... 229/125.05
7,299,941 B2 * 11/2007 McMahon et al. ..... 220/780
7,594,586 B2 * 9/2009 Cai ..... 220/287
2008/0073366 A1 * 3/2008 Backaert ..... 220/785

FOREIGN PATENT DOCUMENTS

EP 1468933 10/2004
EP 2008943 12/2008

OTHER PUBLICATIONS

European Search Report of patent application No. EP08007052.7.
Official Communication of Counterpart European patent application.

* cited by examiner

*Primary Examiner* — Anthony Stashick
*Assistant Examiner* — Niki Eloshway

(57) ABSTRACT

A sealing lid is disclosed that includes a flexible annular closure membrane surrounded by a heavier annular rim member that is preferably adapted to hold the lid in place on a container to define a first position. The closure membrane can be axially flexed from the first position to a second position using a single hand. In the second position, the membrane axially depresses to lower down the pressure in the container and forms a hermetic vacuum seal with the container. The heavier rim member has a weight that is substantially greater than the weight of the membrane that is adapted to press down the lid over the container. The heavier rim member supports hermetic sealing by facilitating intimate contact between the lid and the container.

11 Claims, 13 Drawing Sheets

SEALING LID

BACKGROUND OF THE INVENTION

1. Field of the Invention

The present invention relates to closure devices and more particularly to hand operable sealing closures.

2. Description of the Related Art

It is a common practice to use wraps for enclosing the open ends of the containers. The wraps such as Saran wrap are normally derived from polyvinylidene chloride polymers that have adhering properties so that they cling to a container lip. In the course of time, these wraps loose their adhering strength and easily get punctured and/or torn. These wraps are of light-weight and normally weakly adhere to the container lip, which require the user to put substantial efforts in hermetically sealing the containers. The operation of these wraps is not without other problems. For example, the inability of these wraps to evacuate air from the containers readily spoils the stored contents in a short period of time.

The closures that have the ability to form the vacuum seal normally require an external vacuum source, such as vacuum pump for creating the vacuum. These closures lack their ability to evacuate the containers in the circumstances such as for example, outdoor picnic, traveling, embarking on a trip, where the source of vacuum is unavailable.

The operation of these closures is frequently a two handed practice in which preferably both hands are required to stretch the wrap against the rim of the container to form the hermetic seal. The lack of the ability of these closures to be operated using a single hand limits their convenience for the users that are physically handicapped with one hand.

A sealing lid is needed that exerts sufficient pressure to substantially enclose and evacuate the container and operates using a single hand to form a hermetic vacuum seal with the container.

SUMMARY OF THE INVENTION

A sealing lid is described that comprises a closure membrane and a heavier rim member. The rim member has a weight that is substantially greater than the weight of the membrane. The weight of the heavier rim member allows the lid to press down over a container lip to facilitate intimate contact between the membrane and the container lip. This defines a first position of the closure membrane.

The closure membrane is a flexible silicone membrane that axially depresses in a downward direction after receiving an axial force imparted by few of the fingers of the hand. The axial force pushes the membrane into the container that partially evacuates air from the container. The evacuation of air lowers the pressure in the container and creates suction between the lid and the container. The suction facilitates the lid to form a hermetic seal and thereby defines a second position of the membrane.

BRIEF DESCRIPTION OF DRAWINGS

The above mentioned and other features, aspects and advantages of the present invention will become better understood with regard to following description, appended claims and accompanying drawings, wherein like reference numerals refer to similar parts throughout the several views where:

DESCRIPTION OF THE PREFERRED EMBODIMENT OF THE INVENTION

Figure 1:
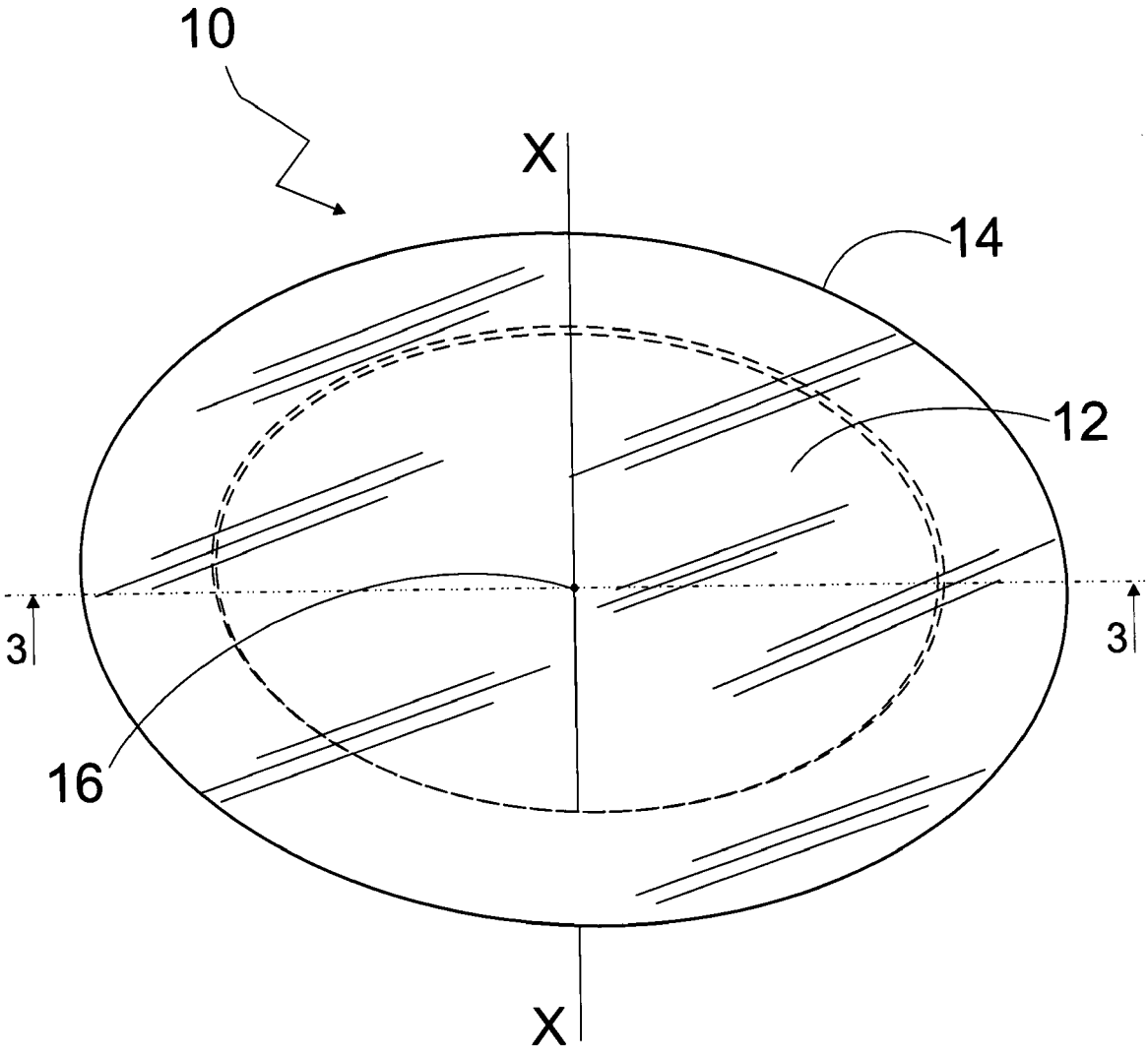
FIG. 1 is a top perspective view of a sealing lid constructed in accordance with the present invention.

Although specific terms are used in the following description for sake of clarity, these terms are intended to refer only to particular structure of the invention selected for illustration in the drawings, and are not intended to define or limit the scope of the invention.

Referring initially to FIG. 1, a sealing lid 10 includes a closure membrane 12 and a rim member 14 that are positioned concentrically to define a common center 16. A central longitudinal axis-X preferably extends from center 16. Closure membrane 12 is integrally connected and surrounded by rim member 14. Closure membrane 12 and rim member 14 have flat surfaces that preferably laterally extend in a plane that is substantially perpendicular to the central longitudinal axis-X. Closure membrane 12 and rim member 14 are made of structurally resilient synthetic organosiloxane elastomer, preferably a silicone membrane. Rim member 14 is preferably made of the same or similar silicone material that is substantially thicker than the membrane 12 so as to have a relatively more rigid structure than membrane 12.

Figure 2:
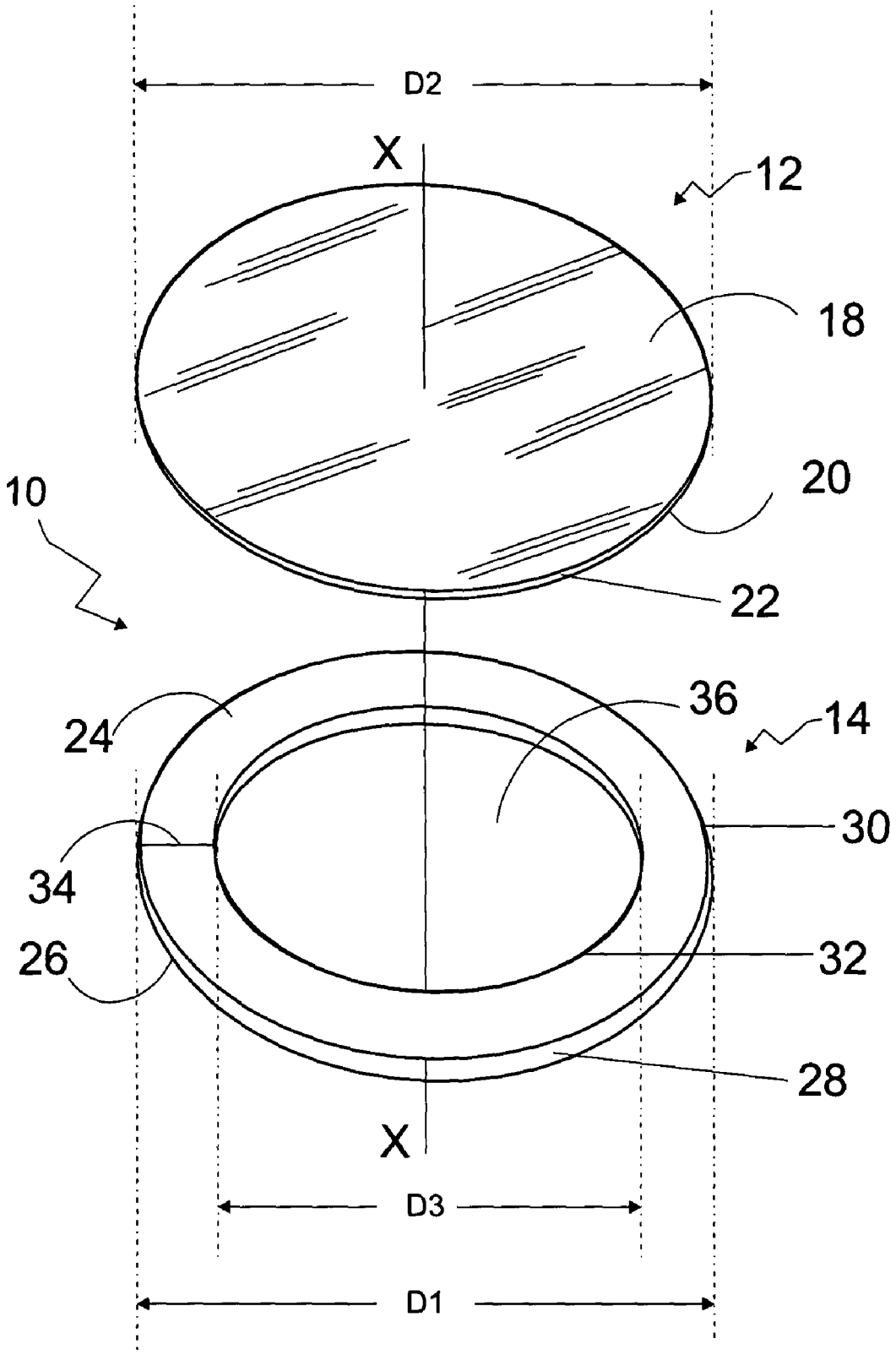
FIG. 2 is an exploded view of one of the sealing lid of FIG. 1.

Referring to FIG. 2, membrane 12 has a first top surface 18 and a first bottom surface 20 that define a first thickness 22. Rim member 14 has a second top surface 24 and a second bottom surface 26 that define a second thickness 28. In this one preferred embodiment, first thickness 22 is approximately one-fourth the second thickness 28, but it is understood that thicknesses 22 and 28 can vary as per the intended use of lid 10.

Rim member 14 has an outer peripheral edge 30 that has a diameter D1 that is substantially equal to a diameter D2 defined by closure membrane 12. Rim member 14 includes an inner peripheral edge 32 that has a diameter D3 that is approximately two-thirds the diameter D2. It is understood, however, that the diameters D1, D2 and D3 can vary as per the intended use of lid 10.

Diameter D1 of outer peripheral edge 30 and diameter D3 of inner peripheral edge 32 define a width 34 of rim member 14 that is approximately one-sixth the diameter D2. Width 34 is preferably configured to be grasped using a single hand of a user. Inner peripheral edge 30 defines an opening 36 in rim portion 14 that is preferably adapted to allow an axial movement of bottom portion 20 of the membrane 12. Top surface 24 is integrally connected to bottom portion 20 of membrane 12 over width 34. Top surface 24 and bottom portion 20 are connected to each other by a molding process, preferably an injection molding. The molding allows closure membrane 12 and rim member 14 to act as a single unitary member. However, it is understood that closure membrane 12 can be connected to rim member 14 using other joining processes such as adhesive bonding, press joining and heat sealing, for example.

Figure 3:
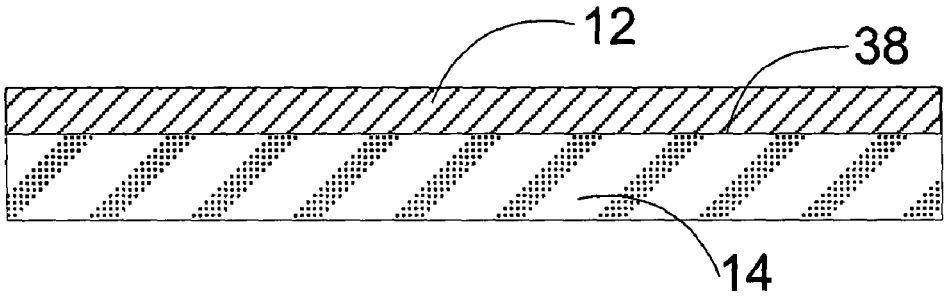
FIG. 3 is a cross sectional front view taken along lines 3-3 of the sealing lid of FIG. 1.

As shown in FIG. 3, rim member 14 is preferably adapted to give support and strength to membrane 12. Closure membrane 12 and rim member 14 define an intersection surface 38 that preferably allows closure membrane 12 to remain approximately flat along a plane that is substantially parallel to the plane defined by the rim member 14.

Figure 4:
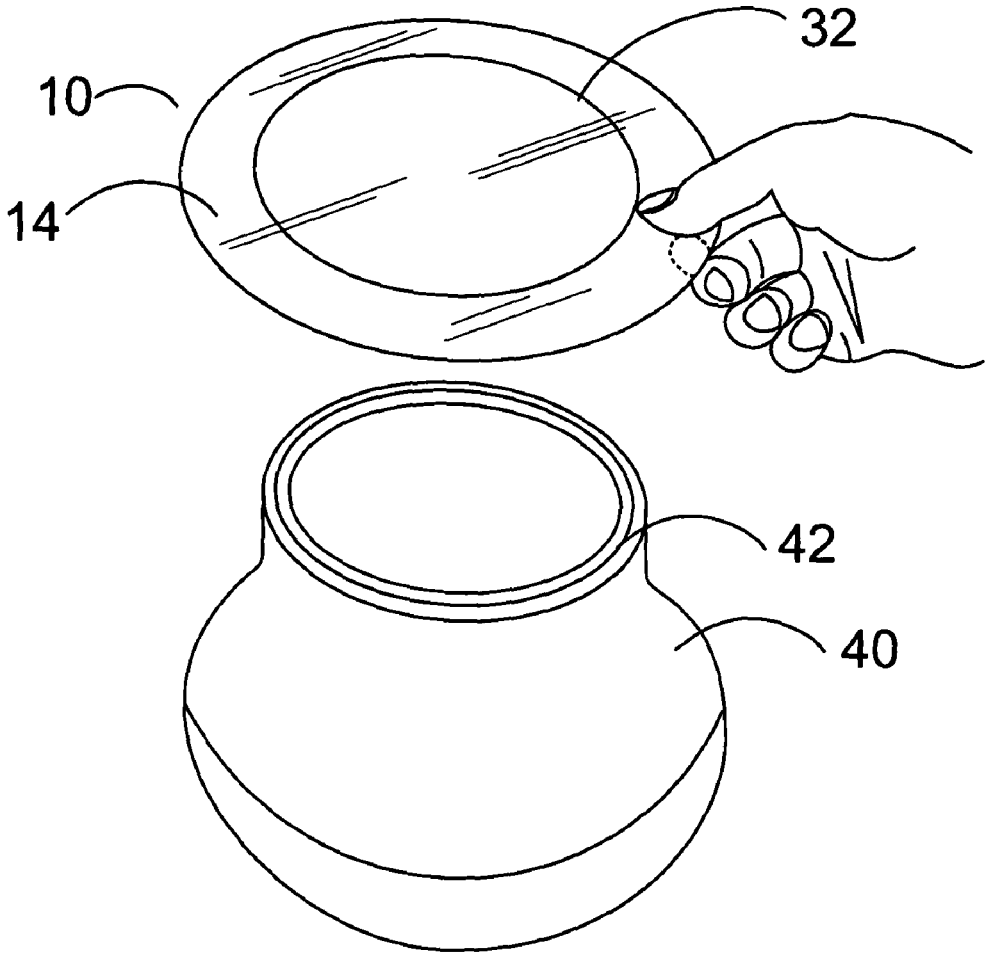
FIG. 4 is a perspective view of the sealing lid of FIG. 1 in use.

As shown in FIG. 4, lid 10 has a circular configuration that is preferably adapted to enclose a circular lip 42 of a container 40. However, it is understood that lid 10 can enclose lip 42 of any shape that has a size preferably less than diameter D3 (refer FIG. 2) of inner periphery 32 of rim member 14. Lid 10 can be advantageously grasped using a single hand and has an overall weight that can be advantageously lifted using the single hand.

Figure 5:
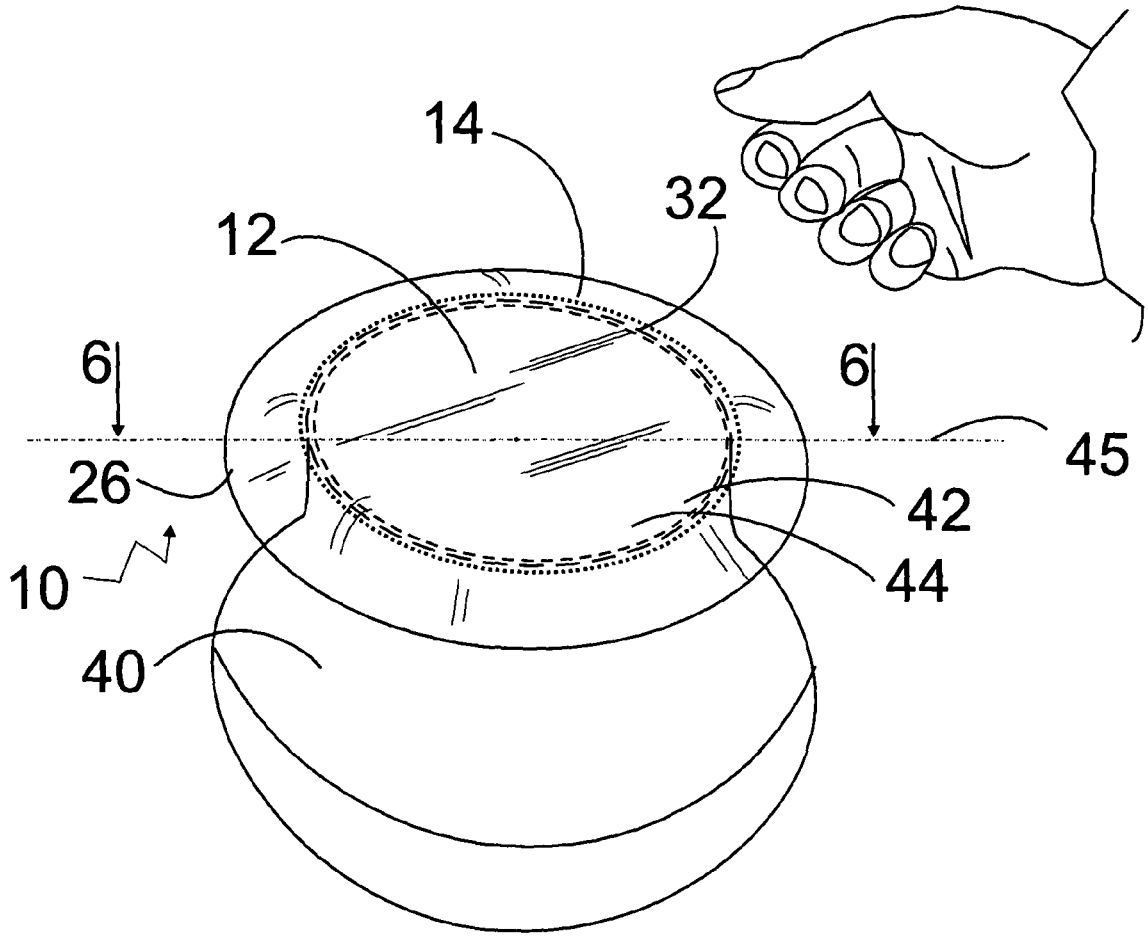
FIG. 5 is a perspective view of the sealing lid of FIG. 1 in a first position of the use.
Figure 6:
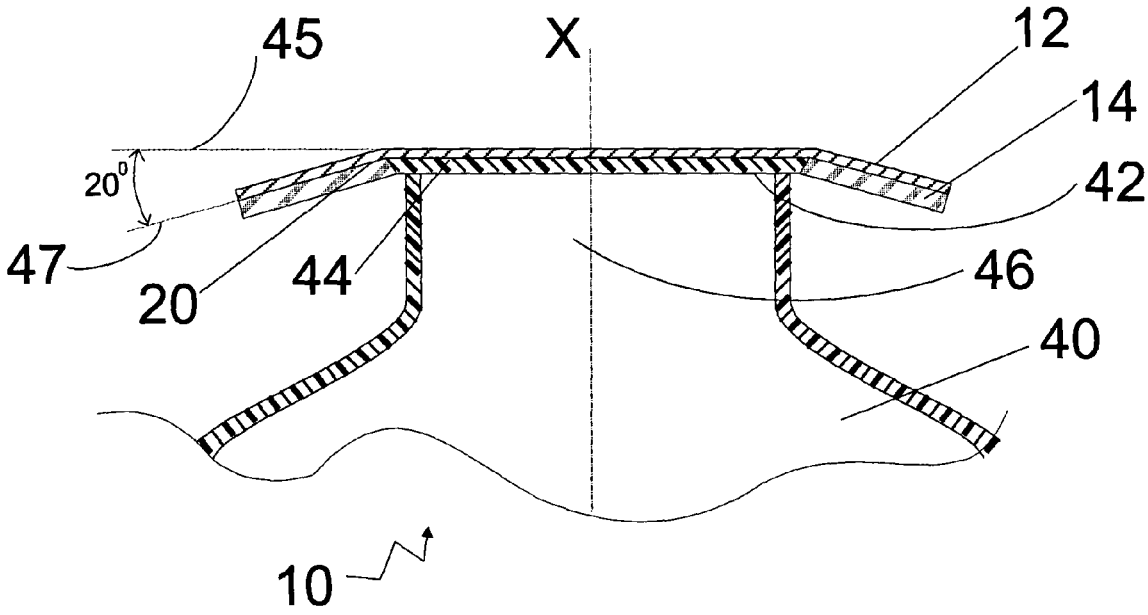
FIG. 6 is a cross sectional view taken along lines 6-6 of the sealing lid of FIG. 5.

Referring to FIGS. 5 and 6, lid 10, in operation, is in a first position that is preferably adapted to enclose an open end of the container 40. In this one preferred embodiment, rim member 14 preferably remains on the underside of membrane 12 and substantially surrounds lip 42 of container 40. Rim member 14 has a weight W1 that is substantially greater than a weight W2 defined by closure membrane 12. This makes rim member 14 heavier than the membrane 12. The weight W1 of heavier rim member 14 allows rim member 14 and at least some portion of closure membrane 12 to press down over lip 42 of container 40. The weight W1 advantageously supports closure membrane 12 to facilitate a hermetic contact with lip 42. In this position, first bottom surface 20 of closure membrane 12 positioned over opening 36 (refer FIG. 2) preferably rests on a top surface 44 of lip 42 and preferably substantially communicates with an open end 46 of container 40. In this position, rim member 14 positioned on the underside of membrane 12 preferably laterally overhangs over lip 42 along a plane 47 that makes an angle of approximately 20° with a plane 45 defined by top surface 44 of lip 42. This firmly holds lid 10 on container 40. In this first position, air in container 40 has a pressure P1 that is substantially equal to atmospheric pressure.

Figure 7:
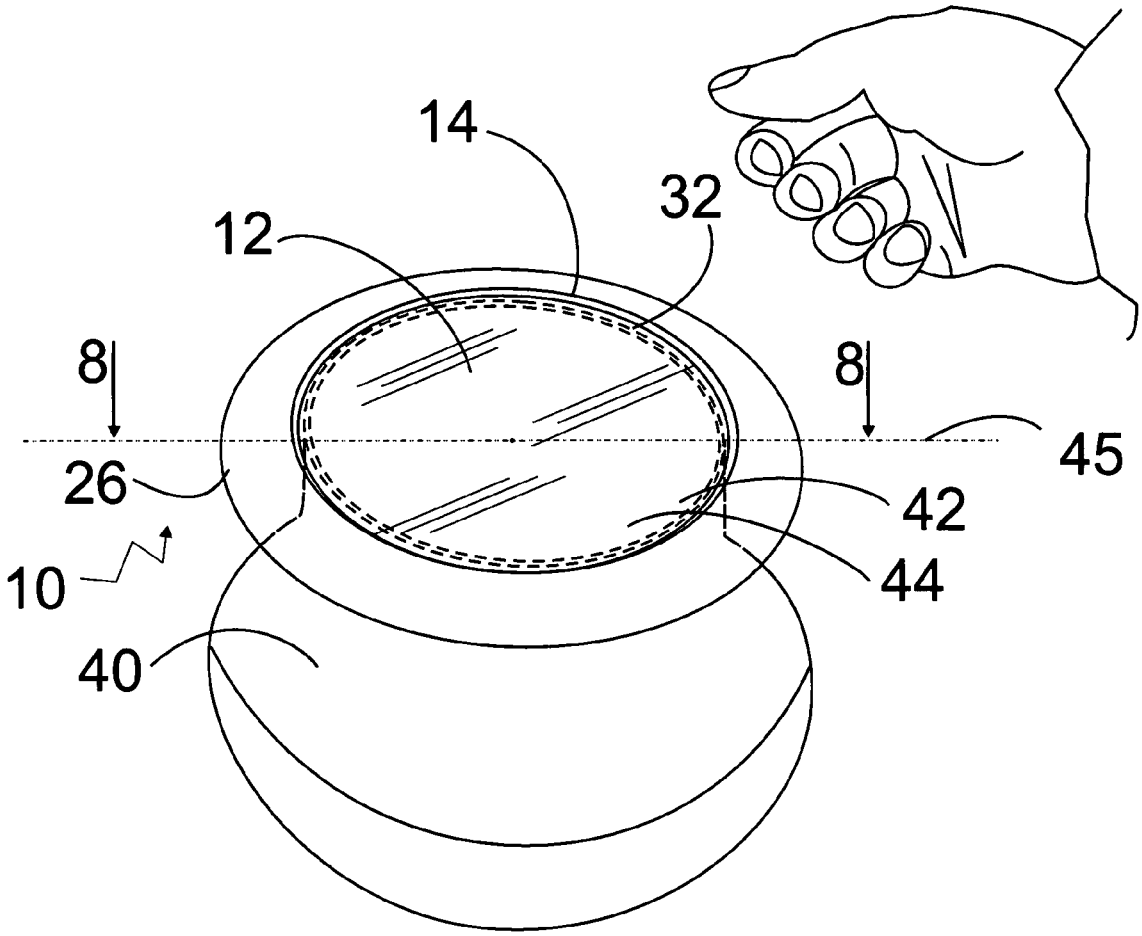
FIG. 7 is a perspective view of an alternative arrangement of the sealing lid of FIG. 1 in a first position.
Figure 8:
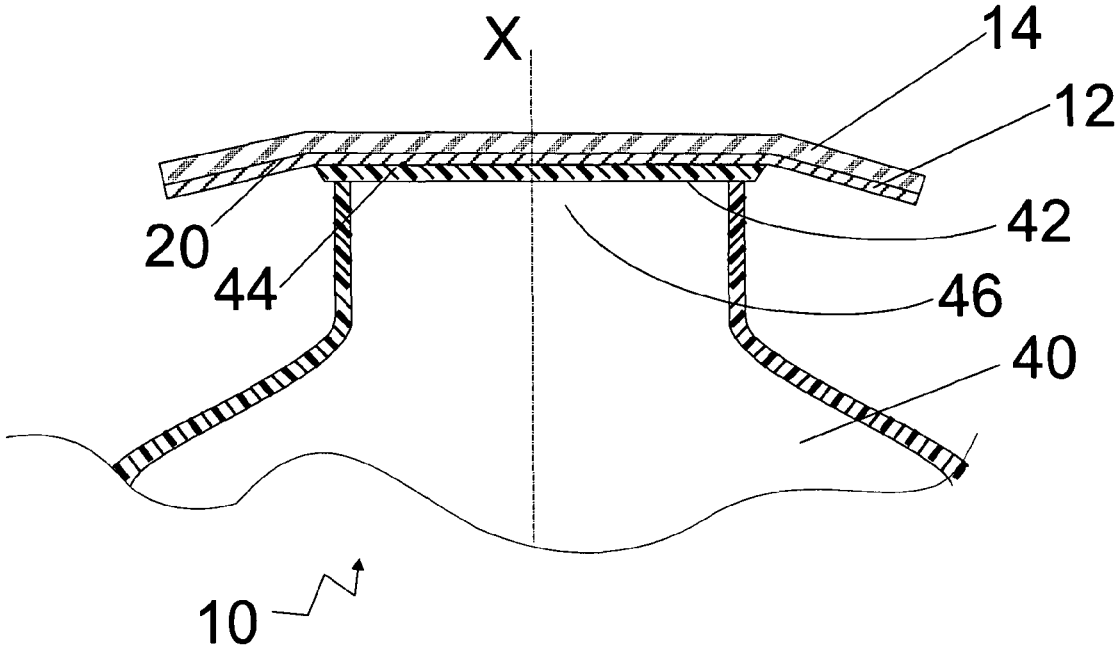
FIG. 8 is a cross sectional view taken along lines 8-8 of the sealing lid of FIG. 7.

Referring to FIGS. 7 and 8, an alternative embodiment of lid 10 is shown wherein the lid 10 is placed in upside down position on lip 42 of container 40. In this one alternative embodiment, closure membrane 12 preferably remains on the underside of the rim member 14. It is understood, however, that in this position also the weight W1 of heavier rim member 14 allows rim member 14 and at least some portion of membrane 12 to press down over lip 42 of container 40.

Figure 9:
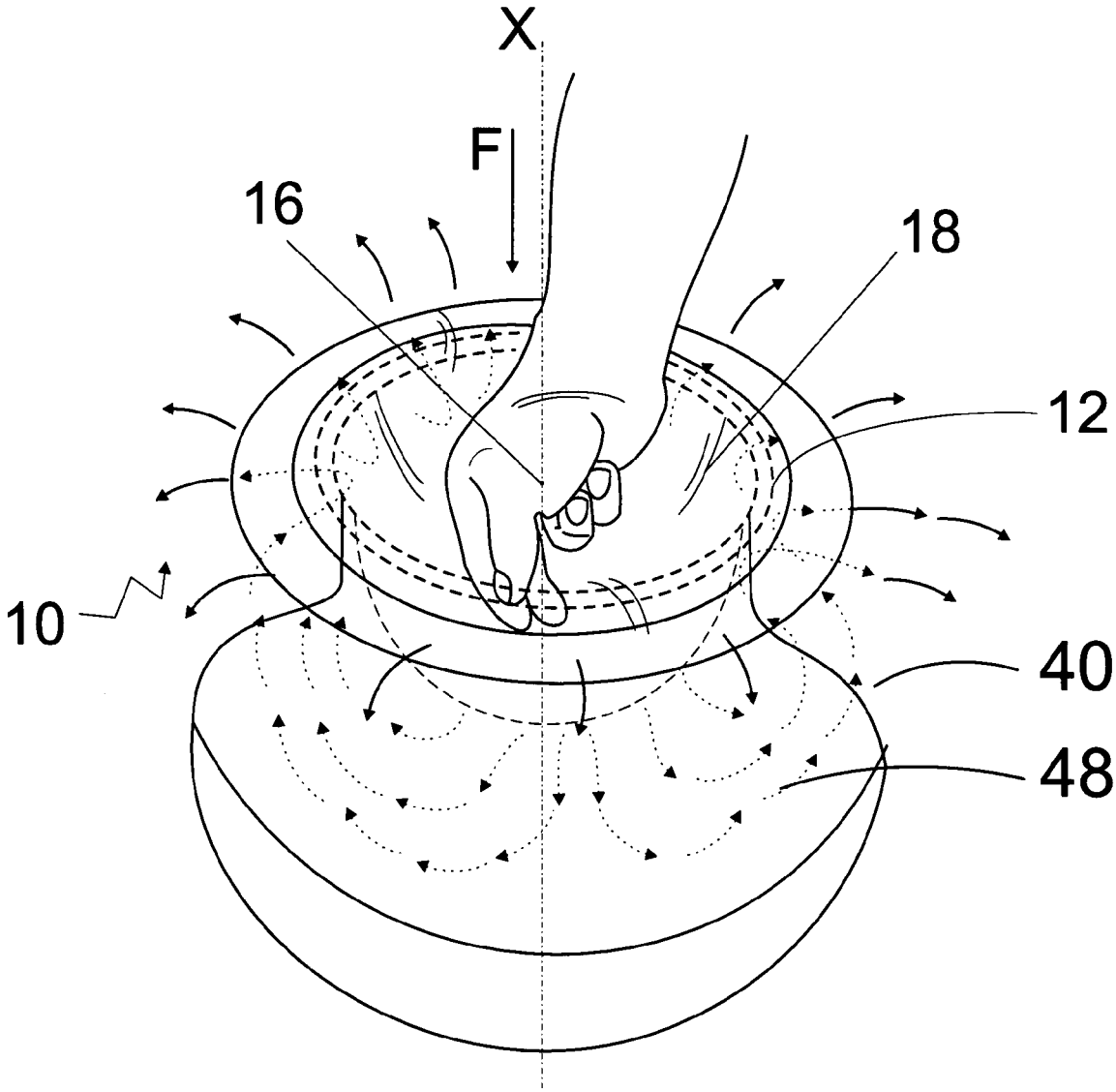
FIG. 9 is a perspective view of the sealing lid of FIG. 1 in a second position of the use.

Referring to FIG. 9, closure membrane 12 positioned over opening 36 (refer FIG. 2) of container 40 preferably receives an axially directed downward force-F by the hand of the user that allows lid 10 to achieve a second position. While directing the force-F, the closure membrane is pushed down gently with at least few fingers of the hand to advantageously direct the force-F on the area around center 16 of lid 10. However, it is understood that the force-F can be applied using any kitchen tool such as, for example, a spoon, a skimmer or a spoon shaped spatula that can be comfortably grasped in the single hand. In the second position, the force-F and the flexible structure of closure membrane 12 axially depress membrane 12 along the central longitudinal axis-X from the first position such that membrane 12 advantageously extends in container 40 in a concave fashion to achieve the second position.

The axial depression of closure membrane 12 forces air out of container 40 and partially evacuates air from container 40. In this one embodiment, the flow of air is shown by a plurality of arrows 48. The evacuation of air reduces initial pressure P1 of container 40 and advantageously achieves a lower pressure P2 that is needed to create suction between lid 10 and container 40.

Figure 10:
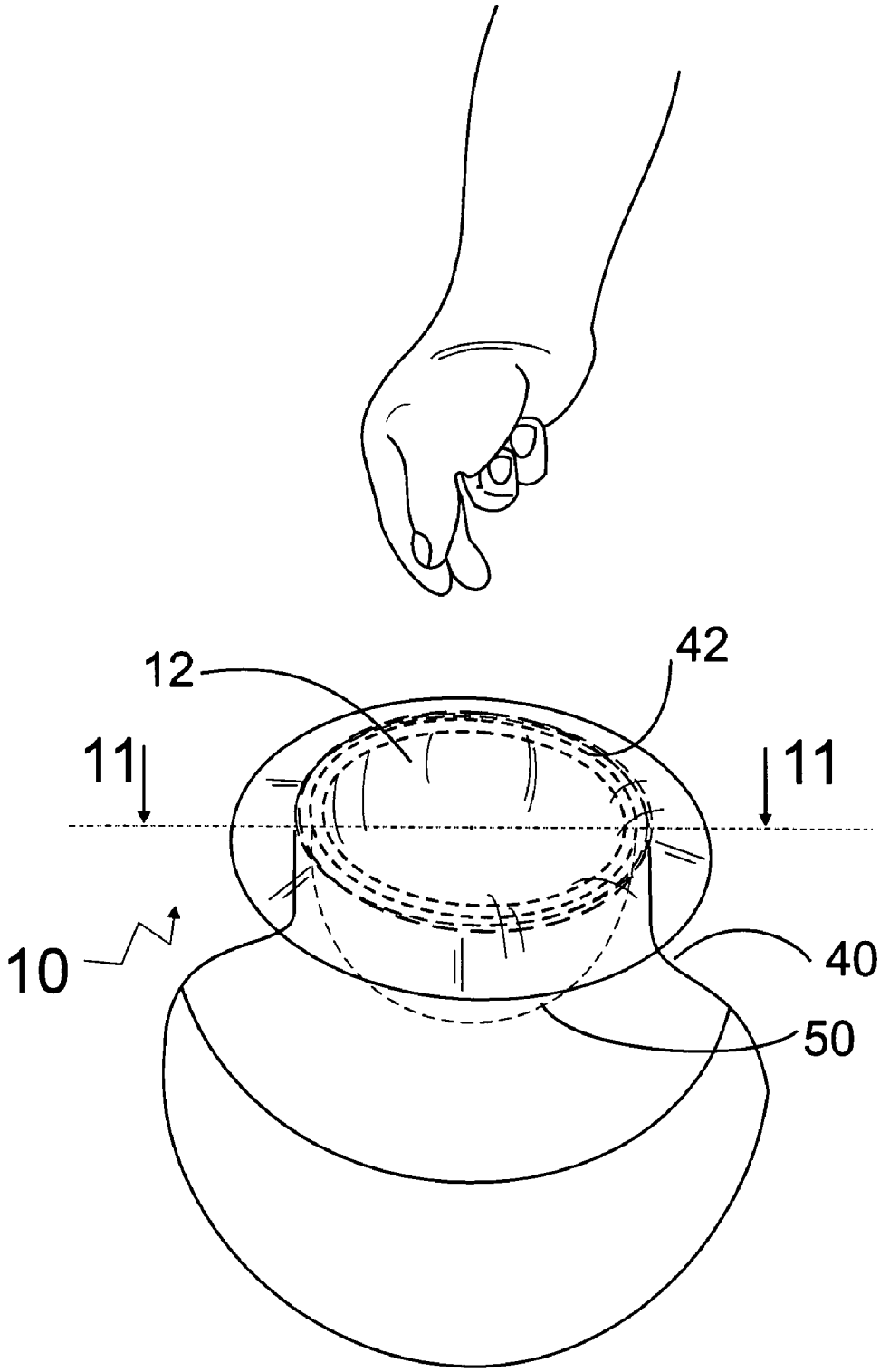
FIG. 10 is a perspective view of the sealing lid of FIG. 1 in the second position.
Figure 11:
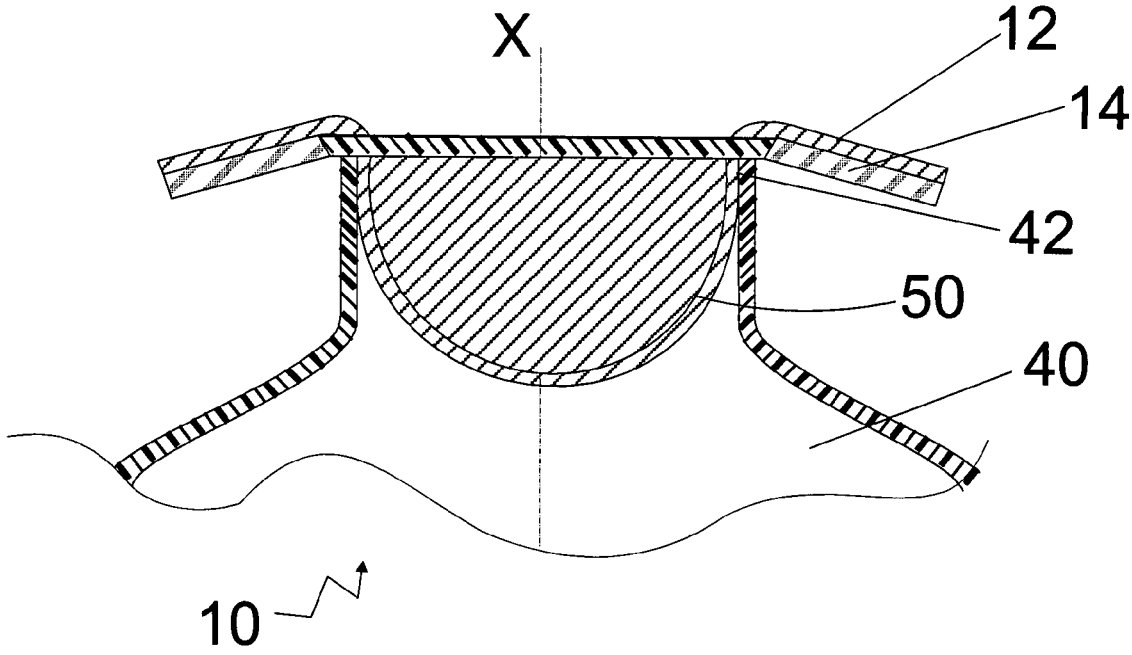
FIG. 11 is a cross sectional view taken along lines 11-11 of the sealing lid of FIG. 10.

As shown in FIGS. 10 and 11, the suction created by lower pressure P2 forms a hermetic seal 50 with container 40. Seal 50 advantageously retains lid 10 in the second position and allows the user to take the hand away from lid 10. The weight W1 of heavier rim member 14 supports hermetic sealing of container 40 by substantially stretching membrane 12 over lip 42.

Figure 12:
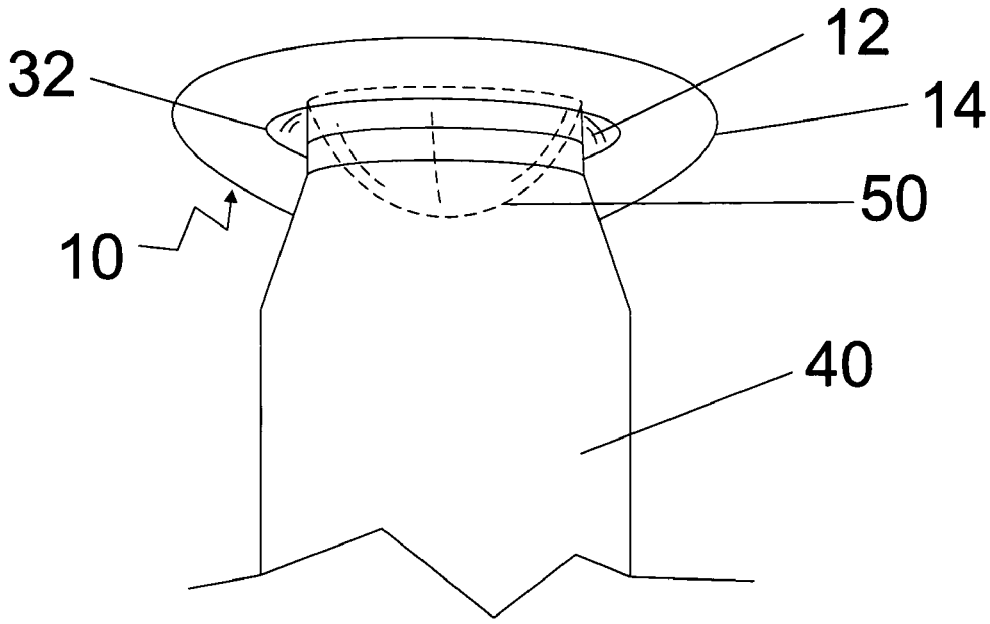
FIG. 12 is perspective view of the measuring device of FIG. 1 in use with an alternative embodiment of a container.
Figure 13:
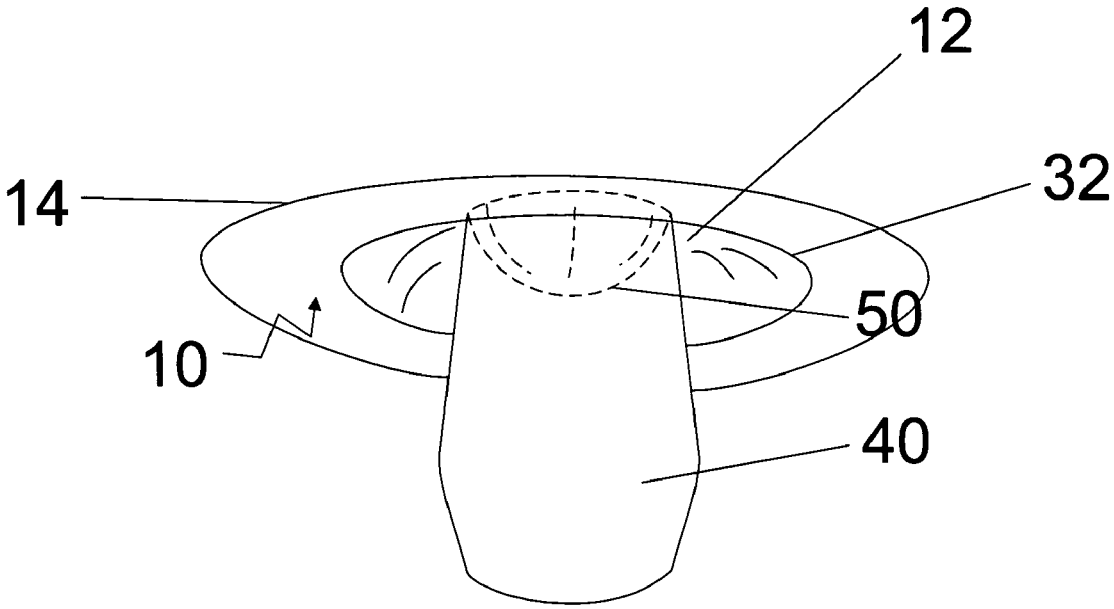
FIG. 13 is perspective view of the measuring device of FIG. 1 in use with an alternative embodiment of the container.

Referring to FIGS. 12 and 13, lid 10 is shown sealing alternative embodiments of containers 40. Lid 10 can form seal 50 with any round shaped container 40 that has an outer diameter equal or less than the diameter D3 (Refer FIG. 2) defined by inner periphery 32 of rim member 14.

Figure 14:
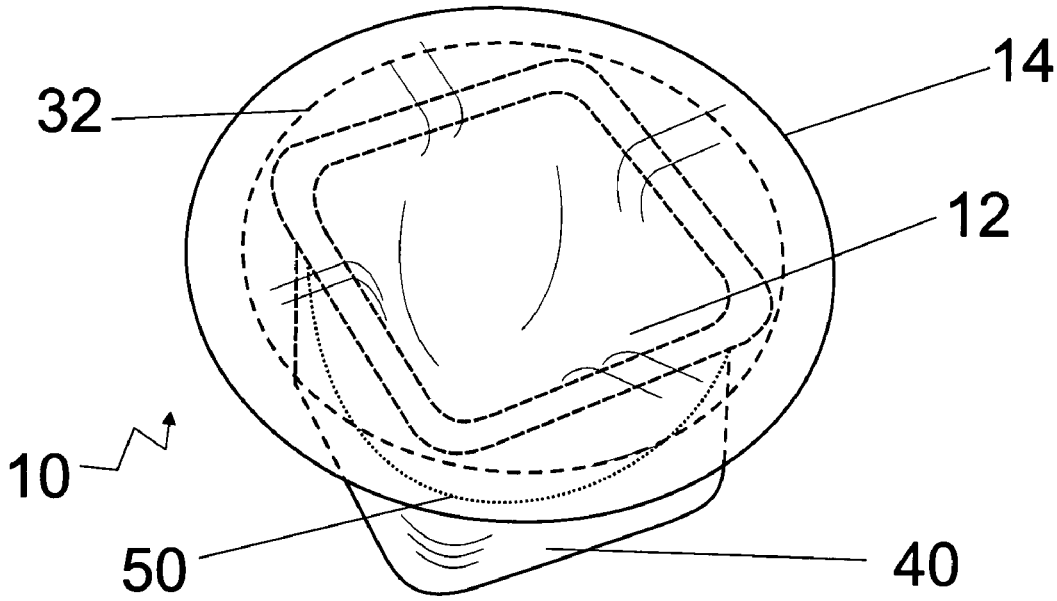
FIG. 14 is perspective view of the measuring device of FIG. 1 in use with an alternative embodiment of the container.
Figure 15:
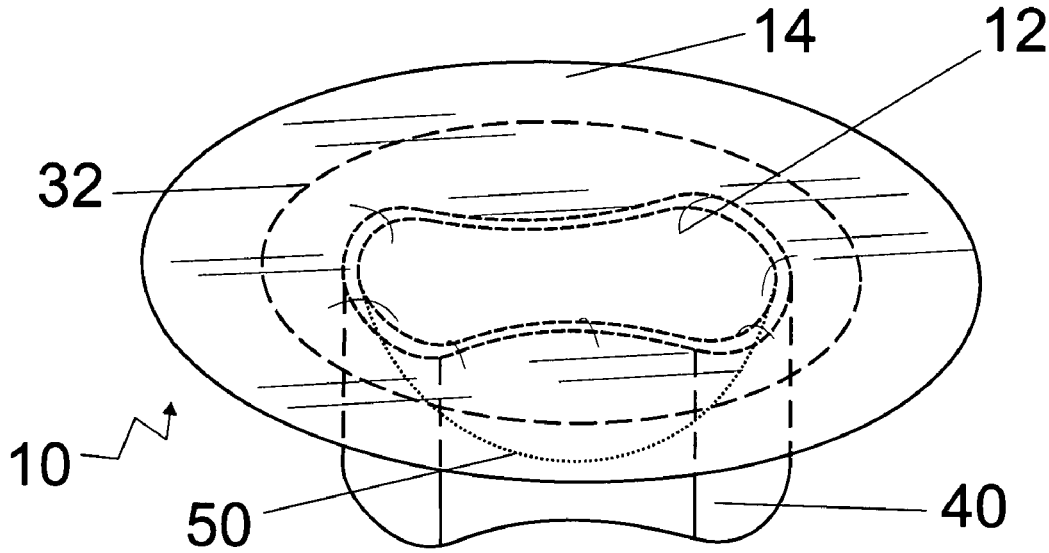
FIG. 15 is perspective view of the measuring device of FIG. 1 in use with an alternative embodiment of the container.
Figure 16:
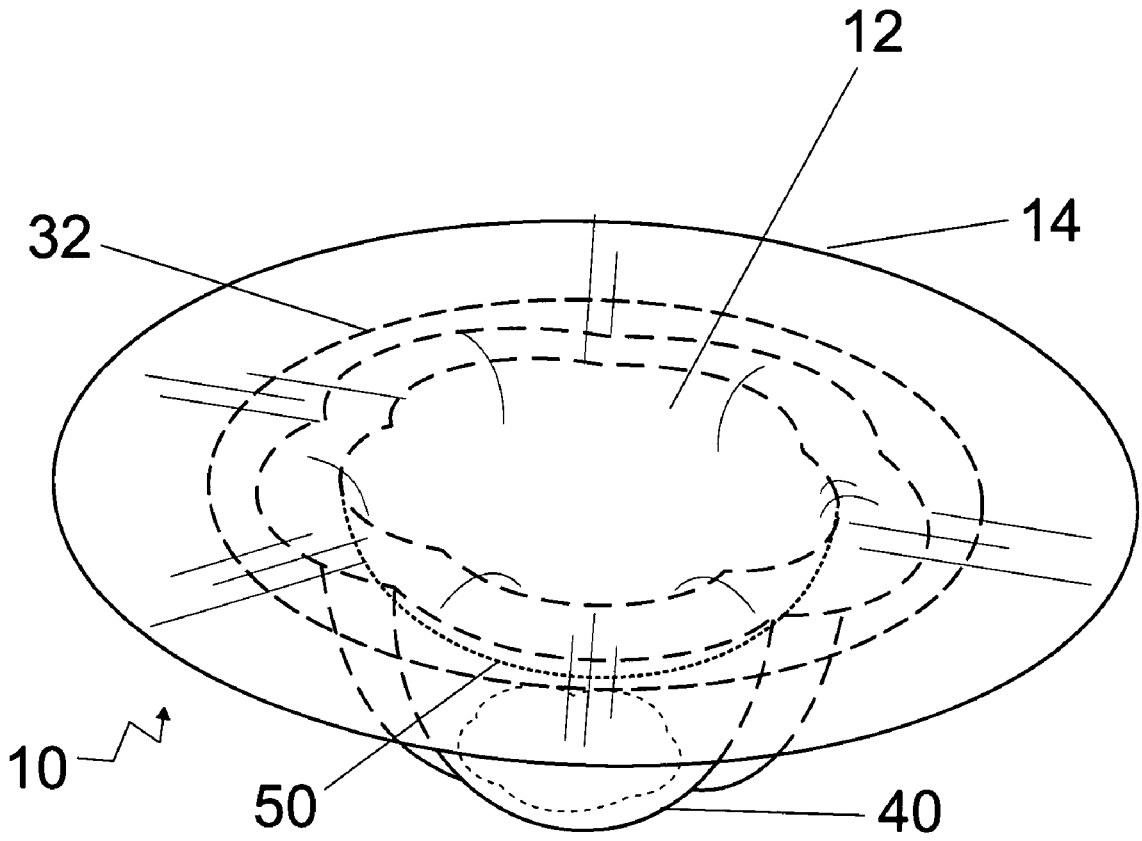
FIG. 16 is perspective view of the measuring device of FIG. 1 in use with an alternative embodiment of the container.

As shown in FIGS. 14, 15 and 16, lid 10 can form seal 50 with any uneven or oddly shaped container 40 that has a configuration equal or less than the diameter D3 (Refer FIG. 2) defined by inner periphery 32 of rim member 14. In these alternative embodiments, lid 10 seals a cubic shaped container 40, an oval shaped container 40, and a rosette shaped container 40 respectively.

Referring to FIGS. 1 to 16, membrane 12 and rim member 14, in operation, have a silicone construction that advantageously allows the user to use the lid 10 in an ordinary oven. Seal 50 formed by lid 10 advantageously vents excess air from container 40 that prevents microorganisms from entering and recontaminating the content stored in container 40. The vacuum seal 50 has a silicone construction that advantageously prevents the non-food items from corrosion and moisture damage. Lid 10 hermetically seals container 40 for advantageously preventing leakage or spoilage of the content stored in the container 40. Lid 10 is advantageously configured to be grasped and operated by the user who is physically handicapped with one of their hands. Lid 10 has a tear and puncture resistant construction that advantageously maintains the food items fresh for the longer period of time.

The embodiments of the invention shown and discussed herein are merely illustrative of modes of application of the present invention. Reference to details in this discussion is not intended to limit the scope of the claims to these details, or to the figures used to illustrate the invention.

What is claimed is:

1. A container assembly comprising a sealing lid and container, the container comprising:

(a) a lip defining a container open end;

the sealing lid comprising:

(b) a silicone closure membrane made of a flexible silicone membrane having a bottom surface;

(c) a heavier silicone rim member having an outer edge defining a first diameter, an inner edge defining a second diameter and a top surface extending from the inner edge to the outer edge, the first diameter being larger than the second diameter;

wherein the bottom surface of the silicone closure membrane is integrally bonded to the top surface of the silicone rim member such that the silicone closure membrane overlies the silicone rim member;

further wherein the sealing lid is adapted to impart a vacuum seal to the container;

the heavier silicone rim member is adapted to hold the lid in place on a container to define a first position, the membrane adapted to be axially depressed from a first position to a second position to hermetically seal the container under a lower pressure;

the rim member has a weight substantially greater than the weight of the membrane adapted to press down the lid over the container to support hermetic sealing; and the lip diameter is less than or equal to the second diameter of the silicone rim member such that the rim member overhangs the container lip along a plane that makes an angle of approximately 20 degrees with a plane defined by a top surface of the lip.

2. The container assembly of claim 1, wherein the membrane can be depressed from the first position to the second position using a single hand.

3. The container assembly of claim 1, wherein the membrane in the first position is approximately aligned to the plane defined by the lip.

4. The container assembly of claim 1, wherein the membrane and the rim member have substantially flat surfaces to make the lid compact.

5. The container assembly of claim 1, wherein the membrane has a thickness that is approximately one-fourth the thickness of the rim member.

6. The container assembly of claim 1, wherein outer peripheral edge of the rim member has a diameter that is approximately equal to a diameter of the closure membrane.

7. The container assembly of claim 1, wherein the inner peripheral edge of the rim member has a diameter that is substantially two-third the diameter of the closure membrane.

8. The container assembly of claim 1, wherein the outer peripheral edge and the inner peripheral edge of the rim member define a width that is approximately one-sixth the diameter of the closure membrane.

9. The container assembly of claim 1, wherein the closure membrane is connected to the rim member by a molding process.

10. The container assembly of claim 1, wherein the closure membrane is connected to the rim member by an adhesive bonding, a press joining or heat sealing.

11. The container assembly of claim 1, wherein the membrane can seal any container that has a size equal or less than a diameter of an inner peripheral edge of the rim member.

* * * * *